United States Patent [19]

Fuchs

[11] Patent Number: 4,762,475

[45] Date of Patent: Aug. 9, 1988

[54] THRUST PISTON PUMP FOR THE DISCHARGE OF MEDIA

[75] Inventor: Karl-Heinz Fuchs, Radolfzell, Fed. Rep. of Germany

[73] Assignee: Ing. Erich Pfeiffer GmbH & Co., KG, Fed. Rep. of Germany

[21] Appl. No.: 850,500

[22] Filed: Apr. 10, 1986

[30] Foreign Application Priority Data

Apr. 24, 1985 [DE] Fed. Rep. of Germany ..... 3514719

[51] Int. Cl.[4] ..... F04B 21/04; F01B 31/00

[52] U.S. Cl. ..... 417/550; 92/130 R; 92/130 B; 222/383; 222/384

[58] Field of Search ..... 267/165; 417/550, 545, 417/581, 552; 92/130 R, 130 B; 222/383, 384, 385, 321

[56] References Cited

U.S. PATENT DOCUMENTS

| | | | |
|---|---|---|---|
| 862,867 | 8/1907 | Eggloston | 417/472 |
| 3,046,894 | 7/1962 | Machen | 92/130 R |
| 3,361,078 | 1/1968 | Cooprider | 222/383 |
| 3,940,070 | 2/1976 | Michel | 222/385 |
| 4,532,967 | 8/1985 | Graf | 222/383 |
| 4,624,413 | 11/1986 | Corsette | 222/383 |

FOREIGN PATENT DOCUMENTS

| | | |
|---|---|---|
| 0073918 | 3/1983 | European Pat. Off. . |
| 1302372 | 4/1972 | Fed. Rep. of Germany . |
| 1703416 | 7/1978 | Fed. Rep. of Germany . |
| 2901038 | 8/1979 | Fed. Rep. of Germany . |
| 1966588 | 5/1980 | Fed. Rep. of Germany . |

*Primary Examiner*—William L. Freeh

*Attorney, Agent, or Firm*—Steele, Gould & Fried

[57] ABSTRACT

A thrust piston pump for the delivery of media has a spring constructed in one piece with the piston rod of a piston unit and located in the pump chamber, which is guided on a sloping surface formed by an internal cone. The piston rod is constructed in such a way that an axially resiliently compressible, sleeve-like piston collar can be fitted from the outer end of the piston rod. The fastening cap can be constructed in one piece with a flange edge, a ring packing and/or a component of the cylinder casing, particularly its cylinder cover. This leads to high pump reliability, in the case of simple construction and easy assembly.

20 Claims, 5 Drawing Sheets

THRUST PISTON PUMP FOR THE DISCHARGE OF MEDIA

BACKGROUND OF THE INVENTION

The present invention relates to a manually operated thrust piston pump for the discharge, delivery or dispensing of media, with a piston unit displaceable in a cylinder counter to at least one bending spring more particularly made from plastic, the pump piston of said piston unit located in the pump axis defining a pump chamber with the cylinder.

A pump which can be mounted on a container of the present type is known (EP No. 00 73 918 A1), which comprises a pump pistoncarrying upper part, a cylinder-forming lower part and a discharge-nozzle carrying cover and which is assembled with the upper part. On the underside of the cover there are spiral springs constructed in one piece therewith and which are arranged in the form of circumferentially curved spring arms on a rim around the pump axis. By means of their free ends, the spring arms are supported on a partition of the lower part at right angles to the pump axis and which surrounds the pump chamber in annular manner. This leads to a very space-consuming housing of the spiral springs, unfavourable spring characteristics and a relatively difficult action of the springs.

SUMMARY OF THE INVENTION

The problem of the present invention is to provide a thrust piston pump of the aforementioned type which, in the case of simple construction, ensures a protected and space-saving housing, as well as easy action of the spiral springs.

According to the invention this problem is solved in the case of a thrust piston pump of the aforementioned type in that the spring forms a single component with the piston unit and is located in the pump chamber. Thus, the spring can be entirely located within the envelope surface of the cylinder or the piston path. Moreover the spring is located in a medium-filled space of the pump, so that particularly in the case of slidable supporting of the spring there is generally a good lubrication by the medium of the surfaces sliding against one another.

A particularly advantageous further development of a thrust piston pump with a piston unit displaceable in a cylinder and in particular of the described type is reached when a its pump piston located in the pump axis and surrounding a piston rod is formed by a sleeve-like elastic piston collar prestressed axially between a rear supporting surface and a front valve seat of a discharge valve. Between its outer end and the supporting surface, the piston rod has a widening and, when assembled, sliding portion for the piston collar widened roughly from the internal cross-section of the piston collar to at least the outer circumference of the supporting surface in the direction of the latter and extending up to said supporting surface. Thus, the spacing between the supporting surface and the valve seat is fixed prior to the assembly of the piston collar, e.g. through a one-part construction of the piston rod and consequently the axially resilient prestressing of the piston collar after assembly is precisely defined. In addition, the piston collar can be fitted by a very simple process, namely from the outer end of the piston rod on to the latter. Through movement in the direction of the supporting surface, the piston collar is automatically widened to such an extent on the widening sliding portion that on passing over the supporting surface it springs back accompanied by resilient constriction and then locks on the supporting surface. During the final displacement of the piston collar when installing the collar on the piston rod, the piston collar is resiliently compressed at least axially from its end belonging to the supporting surface such that it has the pre-tension or prestress corresponding to its prestressed assembly position. However, it is also conceivable to further compress the piston collar and to also allow it to spring back resiliently in the axial direction, accompanied by axial extension, after passing over the supporting surface.

The invention also proposes a thrust piston pump with a cylinder casing having a cylinder cover closing its outer end and a flange edge which in particular projects in one part therewith having a ring packing for the sealed fixing to the opening boundary of an active material vessel, the ring packing being constructed in one part with the flange edge. As opposed to a ring packing formed by a separate, incorporated component, accompanied by simple construction and greatly simplified assembly, this leads to a very reliable sealing engagement of the ring packing, so that this construction s particularly suitable for thrust piston pumps which are to be placed in removable manner on refillable vessels. In addition, the ring package can consequently be given a very compact, space-saving and hygienic construction, because there is a much smaller number of reciprocally engaging sealing surfaces and therefore sealing gaps.

These and further features of preferred developments of the invention can be gathered from the description and drawings, it being possible to realize the individual features individually or in the form of subcombination in a particular embodiment of the invention and in other fields.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
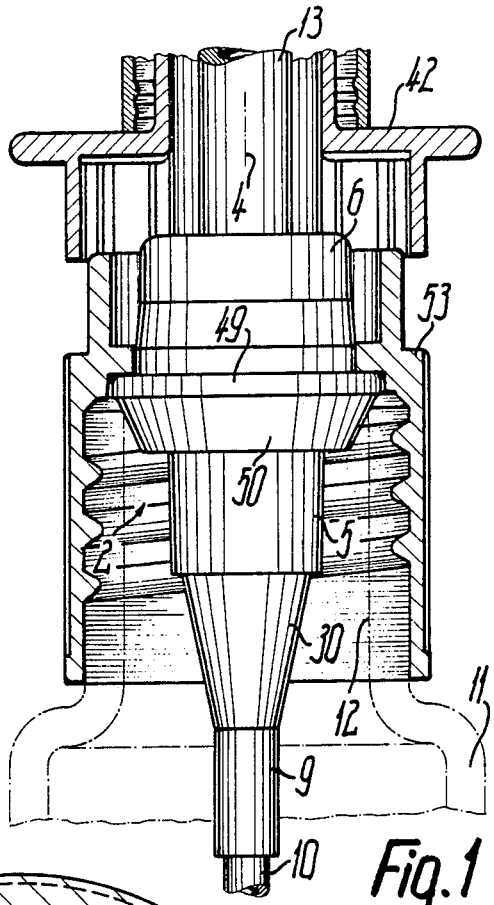
FIG. 1 A thrust piston pump according to the invention substantially in elevation.
Figure 3:
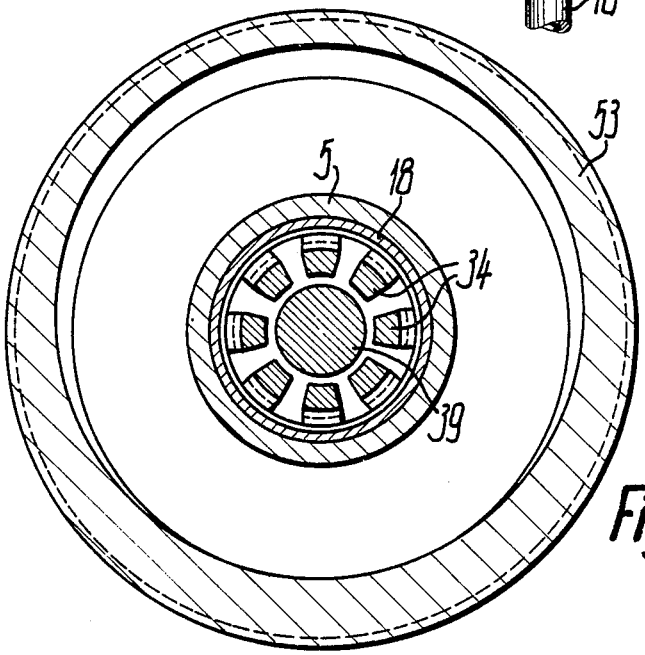
FIG. 3 A section along line III—III of FIG. 2.

As shown by FIGS. 1 to 4, an inventive thrust piston pump 1 has a two-part pump casing 2 and a piston unit 3 in said pump casing which is reciprocable in the direction of the pump axis 4. The pump casing 2 essentially comprises two components, whereof one component, which is reduced in multiply-stepped manner toward the inner end forms, a cylinder, whilst the other component is a sleeve-like cylinder cover 6, which the sleeve-like, concentric shoulders 7, 8 engages over the inner and outer circumference of the outer open end of the other component, except at the end face. In the inner, reduced end portion 9 of the component forming cylinder 5 a hose 10 or the like is inserted as the suction port and its lower end is located in the bottom area of a vessel 11 indicated by dot-dash lines in FIG. 1 and into whose neck 12 is sealingly fixed pump 1.

Piston unit 3 has a piston rod 13, which is assembled from two substantially successively positioned rod parts 14, 15, whose facing ends are inserted in one another and defines an e.g. central discharge passage 16. The piston rod 13 passing through the inner shoulder 7 of cylinder cover 6, within the pump casing 2 carries a sleeve-like piston collar 17 located in pump axis 4 and which over the inner part of its length forms a sleeve-like piston lip 18 widened in frustum-shaped manner towards its free end and having a decreasing wall thickness and at the outer end portion forms a sleeve-like piston neck 19 with an approximately constant wall thickness. In the thickened, sleeve-like transition region between piston lip 18 and piston neck 19 by an annular bead projection provided on its inner circumference the piston collar 17 forms a valve body 21 of a discharge valve 20, which in the closed position according to FIG. 2 engages on an annular valve seat 22 of piston rod 24. Valve seat 22, which is inwardly widened in obtuse-angled, frustum-shaped manner is formed by a ring shoulder of an increased diameter rod head 23 provided at the inner end of piston rod 13, which is larger than the internal diameter of the piston collar 17 in the vicinity of valve body 21 and it is located at least partly within the piston lip 18. The diameter-reduced portion of the piston rod 13 or rod part 15 outwardly connected to the rod head 23 has an external diameter which is at the most as large as the internal diameter of the relieved piston neck 19 or is slightly smaller than the latter. The outer end of piston collar 17 or piston neck 19 is supported by its associated end face on a ring shoulder-like supporting surface 13 of piston rod 13 with axial prestressing, in such a way that in the case of braced engagement of piston collar 17 between valve seat 22 and supporting surface 24, the piston neck 19 is axially resiliently prestressed by compression and bulges slightly e.g. in accordance with FIG. 2. The supporting surface 24 in the represented embodiment is formed by the inner end face of the outer rod part 14, which coaxially surrounds the outer end portion of the inner rod part 15. The inner end of the inner shoulder 7 of cylinder cover 6 forms cooperating stops with the piston collar 17 for fixing the initial position of piston unit 3. To this end the piston collar 17 is provided on the outer circumference in the vicinity of the transition between piston lip 18 and piston neck 19, i.e. roughly in the axial zone of valve body 21 with a frustum-shaped, inwardly widened sealing and abutting surface 25, which when the piston unit 3 in in the initial position engages, under the restoring force acting thereon, on the inner boundary edge of the passage opening 26 for piston unit 3 or piston rod 13 formed by cylinder cover 6 and consequently seals to the outside the associated space of pump casing 2. A stretching force simultaneously acts on the piston collar 17 as a result of this and presses the same, in addition to its inherent resilience, against valve seat 22.

On the outer circumference cylinder 5 forms a cylindrical piston path 27 extending at least over the maximum stroke of piston lip 18 or the pump piston 28 formed by it. Facing pump piston 28, piston path 27 passes over an inner ring shoulder 29 into an internal cone 30 converging in acute-angled manner and which is formed by an extension of the component of pump casing 2 forming cylinder 5. At the inner end of the internal cone 30 a suction valve 31, e.g. in the form of a ball check valve is located in the suction path of the pump immediately adjacent to end portion 9.

Cylinder 5 and internal cone 30 defines a pump chamber 32, in which there is a bending spring 33 as the restoring spring for the piston unit 3. Spring 33 is constructed in one piece with rod head 23 and has a plurality of spring arms 34 uniformly distributed round the pump axis 4, which project freely towards the suction port and diverge in acute-angled manner in this direction in axial section. When piston unit 3 is in the initial position, the free ends 35 of spring arms 34 engage with pre-tension on the sliding surface 36 which slopes with respect to pump axis 4 and which is formed by internal cone 30. The spring arms 34 can be designed in such a way that they are approximately linear in this state.

If the piston unit 3 is forced in the direction of the pump stroke indicated by arrow 37 into cylinder casing 2, then under increasing pre-tension, the spring arms 34 slide along sliding surface 36 until their free ends 35 are at a limited distance from suction valve 31 at the end of the pump stroke and have reached their maximum pre-tension or prestressing. Thus, the deflection of the spring arms 35 takes place radially and inwardly towards pump axis 4. Adjacent to the thus defined deflection side of spring arms 34, a counter-member 38 is provided on the inner end of piston rod 13 and is formed by a center ram 39 common to all spring arms 34, located in pump axis 4 and whose circumferential surface in axial section passes in acute-angled manner into the radially inner boundary surfaces of spring arms 35. As a result of this counter-member 38 there is an increased rigidity of spring arms 34, as well as a reduction of the free volume of pump chamber 32 at the end of the pump stroke. By their ends passing into piston rod 13, spring arms 34 are partly located within piston collar 18, so that a very space-saving, compact construction is obtained. The radially outer surfaces 40 of spring arms 34 remote from pump axis 4 lead directly to the outer circumference of valve seat 22.

Figure 4:
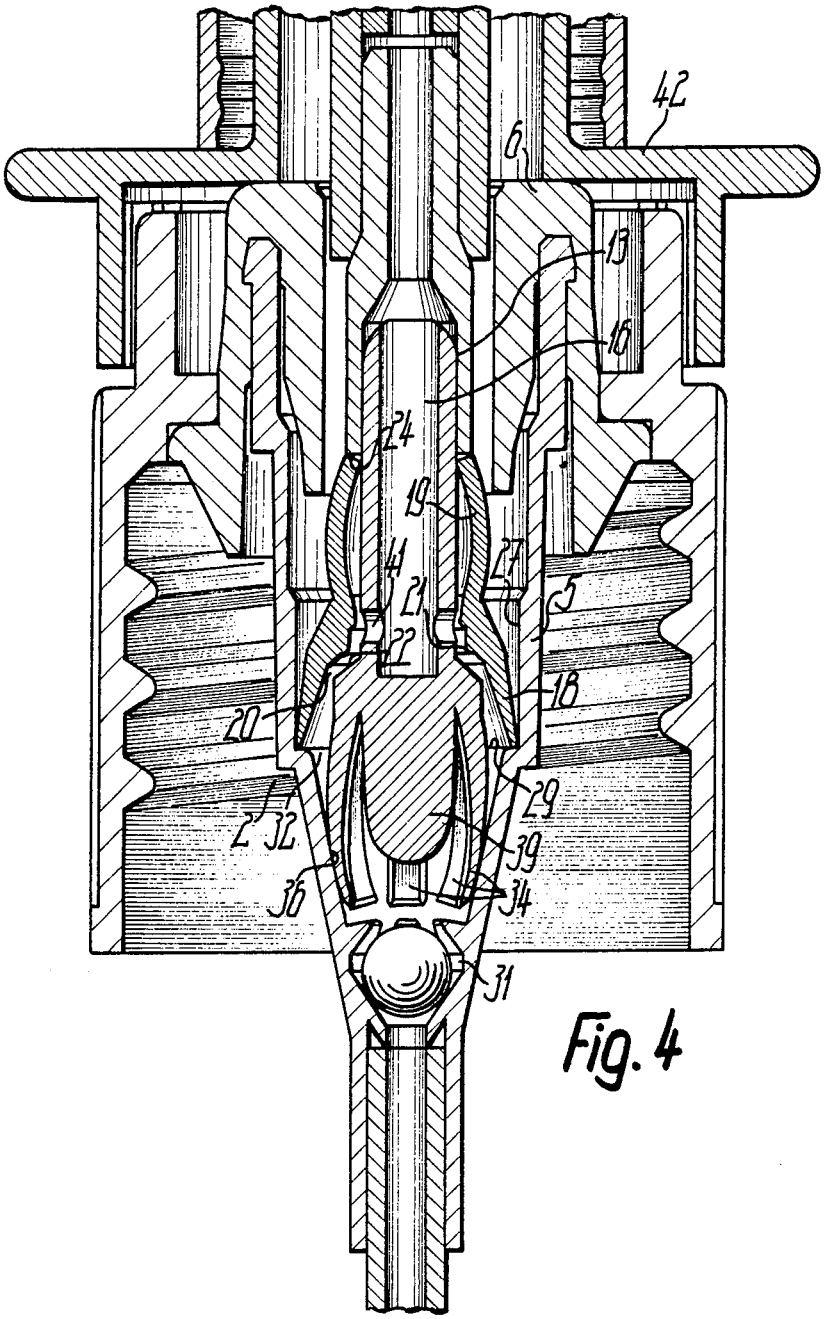
FIG. 4 A view corresponding to FIG. 2, but at the end of the piston stroke.

The discharge passage 16 of piston rod 13 terminates as a blind hole in the vicinity of rod head 23 and is connected via transverse passage 41 to the cylindrical jacket-like space between valve seat 22 and supporting surface 24 within piston collar 17. At the end of the pump stroke of pump piston 28, piston lip 18 runs on to ring shoulder 29 according to FIG. 4, after which the piston rod 13 can be moved by a preselected opening path into pump casing 2 until it reaches its associated stop position. Valve body 21 according to FIG. 4 is raised from valve seat 22 and consequently the discharge valve 20 is opened, so that the medium which is under pressure in pump chamber 32 with suction valve 31 closed can escape suddenly through the discharge valve 20, transverse passages 41 and discharge passage 16. On the outer end of piston rod 13 is e.g. mounted a discharge head 42 for the manual operation of the pump and which has an outlet opening (not shown) of the pump. The pump is particularly suitable for subjecting the medium to be discharged to dosing, atomizing, etc. Through the opening of the discharge valve 20, the piston neck 19 is axially resiliently tensioned, accompanied by further bulging. As soon as the piston unit 3 is relieved by release at the end of the piston stroke, a restoring force acts thereon which, at the start of the return stroke, is not only produced by the spring 33, but also by the piston neck 19 until valve 20 is closed. As soon as valve 20 is closed, spring 33 returns piston unit 3 to its initial position according to FIG. 2.

Figure 6:
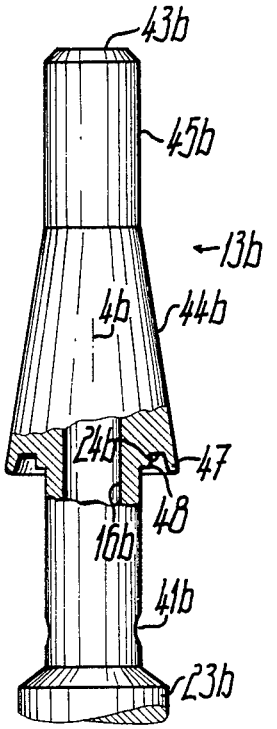
FIG. 6 A detail of a further piston unit in axial section.
Figure 5:
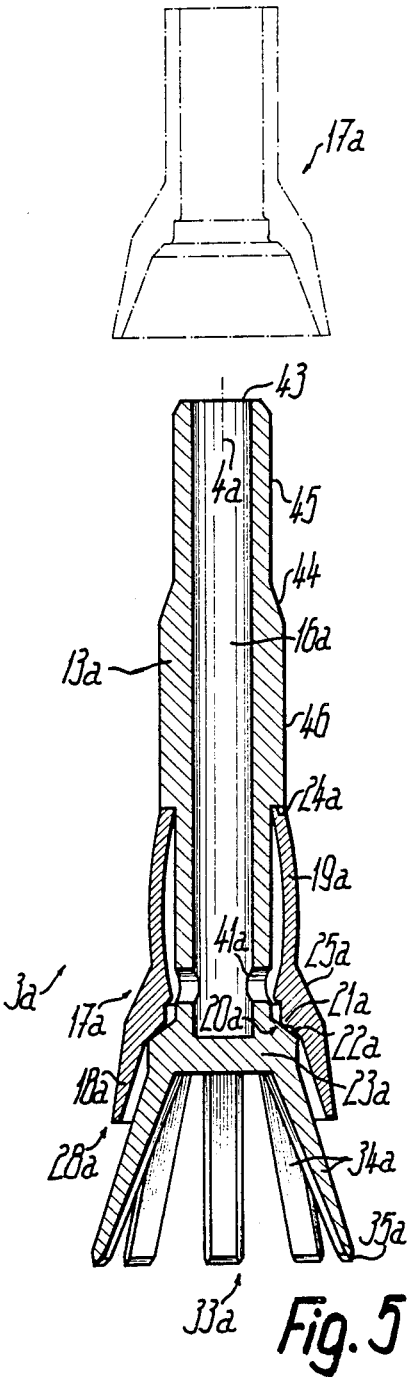
FIG. 5 Another embodiment of a piston unit for the thrust piston pump in axial section.
Figure 7:
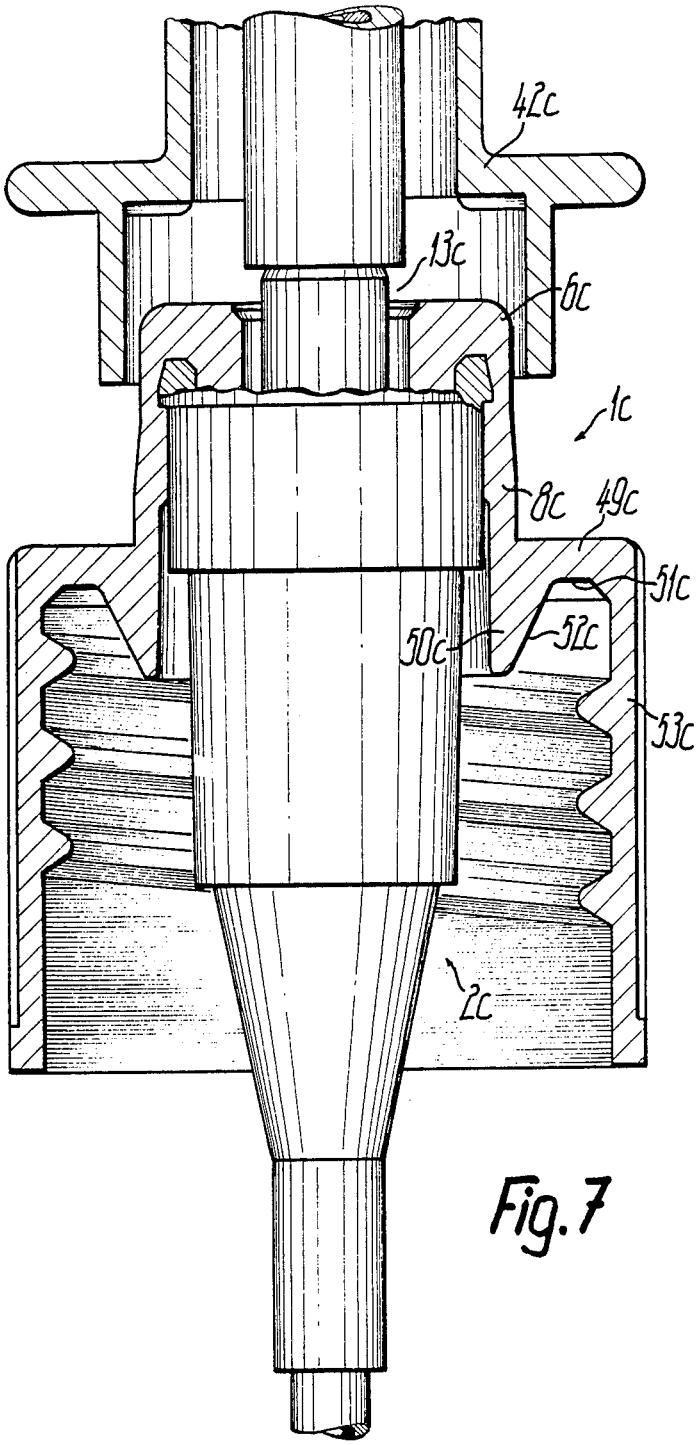
FIG. 7 Another embodiment of a pump casing, partly in axial section.

In FIGS. 5 to 7, corresponding parts are given the same reference numerals as in FIGS. 1 to 4, but the letter "a" is added in FIG. 5, the letter "b" in FIG. 6 and the letter "c" in FIG. 7.

In the embodiment according to FIG. 5, the piston rod 13*a* of piston unit 3*a* is constructed in one piece over its entire length, so that the entire piston unit 3*a* only comprises two components, i.e. piston rod 13*a* and piston collar 17*a*, the pump restoring spring also being constructed in one piece with piston rod 13*a*. Unlike in the embodiment according to FIGS. 2 to 4, within the spring arms 34*a* of spring 33*a*, rod head 23*a* has not central ram. According to FIG. 5, even in the completely relieved state, the spring arms 34*a* can be approximately linear. Towards the free ends 35*a* thereof, they are approximately uniformly tapered in acute-angled manner in thickness.

So that despite the relatively wide rod head 23*a* at the inner end of piston rod 13*a* and so that despite its one-piece construction, the piston collar 17*a* can be transferred from the unfitted state indicated by dot-dash lines in FIG. 5 into the fitted state, piston rod 13*a* is provided between its outer end 43 and the supporting surface 24*a* with a widening sliding portion 44 widened from the internal cross-section of piston collar 17*a* to the outer circumference of supporting surface 24*a* and which on the outer circumference of piston rod 13*a* is located between two assembly sliding portions 45, 46, which have a constant width over their length and are preferably cylindrical. The widening sliding portion 44 is formed by a circumferential portion, which is widened in acute-angled, frustum-shaped manner from the smaller external diameter of the outer assembly sliding portion 45 extending up to end 43 to the larger diameter of the inner assembly sliding portion 46, which has the same diameter as the supporting surface 24*a* on the outer circumference and extends continuously thereto. The external diameter of the outer assembly sliding portion 45 is appropriately at the most as large as the internal diameter of the completely relieved piston collar 17*a* or its piston neck 19*a*. For assembly purposes, piston collar 17*a* is mounted from the outer end 43 on the piston rod 13*a* and is passed over the widening sliding portion 44 and is thereby resiliently widened. When valve body 21*a* has reached the valve seat 22*a*, the free end of the piston neck 19*a* is still in the vicinity of the assembly sliding portion 46. Piston neck 19*a* is now axially resiliently compressed from its outer end face associated with supporting surface 24*a* until the outer end of piston neck 19*a* has travelled over the supporting surface 24*a* and under rebounding radial constriction jumps into the assembly position associated with the supporting surface 24*a* in which the axial pretension of piston collar 17*a* is maintained with an accurately predetermined magnitude. The widening of the outer end of piston neck 19*a* can take place in such a way that in the vicinity of the supporting surface 24*a*, neck 19*a* engages with radially inwardly directed pretension on the portion of piston rod 13*a* connected to the inner circumference of supporting surface 24*a*.

Figure 2:
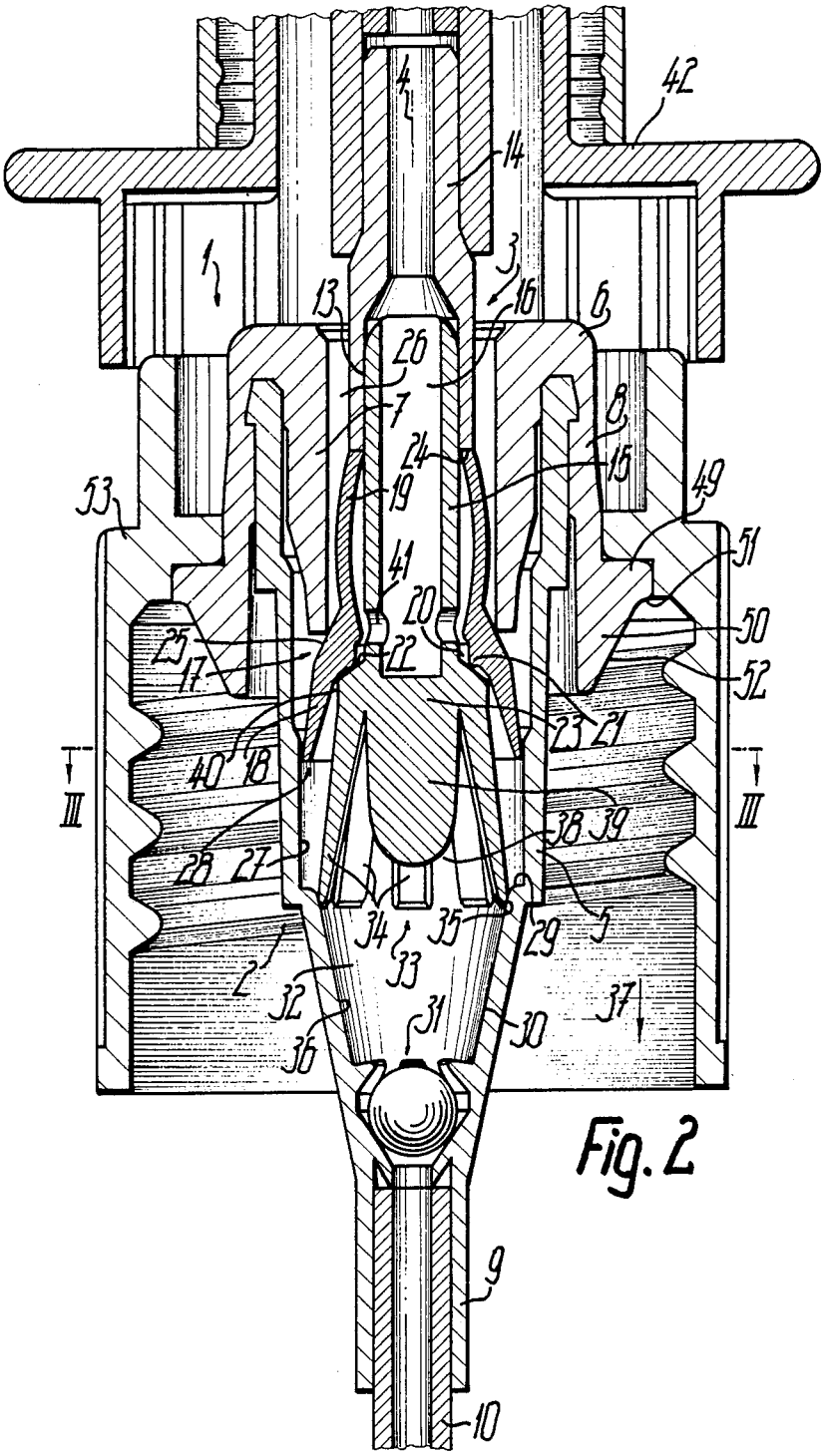
FIG. 2 The thrust piston pump according to FIG. 1 in axial section and in the starting position.

The widening sliding portion 44, which can also be used in the case of a two-part construction of the piston rod according to FIGS. 2 and 4 is, as shown in these Figures, appropriately simultaneously the stop shoulder for the discharge head 42 to be mounted on the outer end portion of piston rod 13, so that through this stop shoulder the axial position of discharge head 42 with respect to piston rod 13 is precisely determined. So that discharge head 42 engages in the piston rod over a relatively long length, the widening sliding portion 44 appropriately starts roughly in the centre of the length between outer end 43 and supporting surface 24*a*.

As shown in FIG. 6, the widening sliding portion 44*b* can also extend approximately up to the supporting surface 24*b*, so that the inner assembly sliding portion 46 according to FIG. 5 is omitted and the widening of the piston collar takes place over a larger axial displacement path with respect to piston rod 13*b*. Moreover the supporting surface 24*b* can be formed by a recessed annular front shoulder, which is defined on the outer circumference by a flange 47 projecting over it and which can be formed by a closed ring flange or individual disk cams distributed over the circumference. The outer circumference of flange 47 appropriately forms a continuous extension of the widening sliding portion 44*b* or in the case of the construction of FIG. 5 the assembly sliding portion extending up to the supporting surface. Flange 47 positively secures against widening the associated end of the piston neck of the piston collar. To obtain an increased, radially braced engagement of the outer end of the piston collar neck on the circumference of piston rod 13*b*, connecting on to the inner circumference of supporting surface 24*b* said rod can have an inner flange 48 with an increased diameter and the outer end of the piston neck sealingly engages thereon by its inner circumferential surface after assembly.

As is also shown by FIGS. 1, 2 and 4, pump casing 2 has an annular flange edge 49 projecting over its outer circumference and which serves to engage the pump on the outer end face of vessel neck 12 and is constructed in one piece with of pump casing 2 and in the represented embodiment with cylinder cover 6. The flange edge is located on the inner end of the outer sleeve-like shoulder 8 of cylinder cover 6 and projects over its outer circumference. For sealing the opening of the vessel neck 12 in the vicinity of the inserted thrust piston pump 1 a ring packing 50 is provided, which is constructed in one piece with flange edge 49 and consequently with cylinder cover 6. The ring packing 50 projects axially inwards over the ring shoulder 51 formed by the inner end face of flange edge 49 and provided for engagement on the end face of vessel neck 12. The sealing surface 52 formed by the outer circumference of ring packing 50 is tapered in acute-angled, frustum-shaped manner towards its inner end and has its greatest width following on to ring shoulder 51 and said width is slightly larger than the width of the opening of vessel neck 12. The ring packing 52 rests freely on the preferably cylindrical inner circumference, i.e. it is radially spaced from the adjacent outer circumference of pump casing 2, so that it can spring radially inwards without deforming the pump casing. A fastening cap 53 is used for fixing the thrust piston pump 1 to vessel 11 and e.g. engages over the outer circumference of vessel neck 12 as a screw cap and with its inner shoulder engages on the outer annular end face of flange edge 49, so that the latter is held against the end face of vessel neck 12 and the ring packing 52 engages with radial sealing pressing action into neck 12.

FIG. 7 shows that the fastening cap 53*c* can also be constructed in one piece with one component of pump casing 2c and in the represented embodiment with cylinder cover 6c. The end wall of fastening cap 53c appropriately forms the flange edge 49c, which in turn passes in one piece both into the outer sleeve-like shoulder 8c of cylinder 6c and into the ring packing 50c.

The construction according to the invention makes it possible to manufacture thrust piston pumps ensuring very reliable operation, whilst having a very small number of components. In a preferred embodiment, the complete piston rod and restoring spring are formed by a single one-piece component, whilst the cylinder casing or its cylinder cover can be combined with the fastening cap, flange edge and vessel seal to from a single component.

What is claimed is:

1. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33) counteracting displacement of said piston unit (3) in said piston pump;

a pump chamber (32) defined by said pump piston (17) and said cylinder (5); and, wherein the bending spring (33) is formed by a single component common with the piston unit (3), is located in the pump chamber (32) and moves commonly with said piston unit (3).

2. A thrust piston pump according to claim 1, wherein said bending spring (33) and said piston unit (3) are made from elastic material.

3. A thrust piston pump according to claim 1, wherein in the relieved state the bending springs (33) are substantially linear.

4. A thrust piston pump according to claim 1, wherein the piston unit (3) is displaceable from an initial position, the bending springs (33) being substantially linear in said initial position of the piston unit (3).

5. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33) counteracting displacement of said piston unit (3) in said piston pump;

a pump chamber (32) defined by said pump piston (17) and said cylinder (5); and, wherein the bending spring (33) is formed by a single component common with the piston unit (3) and is located in the pump chamber (32), the bending spring (33) being at least partly located within the pump piston (17) of the piston unit (3).

6. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33) counteracting displacement of said piston unit (3) in said piston pump;

a pump chamber (32) defined by said pump piston (17) and said cylinder (5); and, wherein the bending spring (33) is formed by a single component common with the piston unit (3) and is located in the pump chamber (32), the piston unit (3) having a sleeve-like piston collar (17), the bending spring (33) being at least partly located in the sleeve-like piston collar (17) of the piston unit (3).

7. A manually operated thrust piston pump for delivering media, said thrust piston pump comprising:

a piston unit (3) having a pump piston (17) located substantially along a pump axis (4);

a cylinder (5) for displaceably receiving said piston unit (3);

at least one return spring (33) formed by a bending spring (33), said return spring counteracting displacement of said piston unit (3) in said piston pump;

a pump chamber (32) defined by said pump piston (17) and said cylinder (5); and, wherein the piston spring (33) is formed by a single component common with the piston unit (3) and is located in the pump chamber (32), said bending spring (33) being guided on a sliding surface (36) sloping with respect to the pump axis (4).

8. A manually operated thrust piston pump according to claim 7, wherein said cylinder (5) has a piston path (27) and said sliding surface (36) is provided directly following said piston path (27) of the cylinder 95).

9. A thrust piston pump according to claim 7, wherein said sliding surface (36) is formed by an internal cone (30) linked by means of a ring shoulder (29) to the piston path (27).

10. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33) counteracting displacement of said piston unit (3) in said piston pump;

a pump chamber (32) defined by said pump piston (17) and said cylinder (5), and wherein the bending spring 933) is formed by a single component common with the piston unit (3) and is located in the pump chamber (32), the bending spring having a plurality of freely projecting arms (34) distributed around the pump axis (4) and having free ends (35).

11. A thrust piston pump according to claim 10, wherein said spring arms (34) diverge towards their free ends (35) in a relieved state.

12. A thrust piston pump according to claim 10, wherein said spring arms (34) provide a pretensioned initial position in the pump, said spring arms (34) diverging towards their free ends (35) in said pretensioned initial position.

13. A thrust piston pump according to claim 10, wherein said spring arms (34) diverge at acute angles.

14. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring 933) formed by a bending spring (33), said return spring (33) counteracting displacement of said piston unit (3) in said piston pump;

a pump chamber (32) defined by said pump piston (17) and said cylinder (5), said piston unit (3) being displaceable over a pump stroke, wherein the bending spring (33) is formed by a single component common with the piston unit (3) and is located in the pump chamber (32), the bending spring deflecting to a deflecting side while the piston unit (3) is displaced during the pump stroke, a counter member (38) for the bending spring (33) being provided adjacent to the deflecting side of the bending spring (33), said counter member (38) being located adjacent to an end of the bending spring (33), said end being located at the piston unit (3).

15. A thrust piston pump according to claim 14, wherein the counter member (38) is formed by a common center ram (39) for all the bending springs (33).

16. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33), counteracting displacement of said piston unit (3) in said piston pump;

a pump chamber (32) defined by said pump piston (17) and said cylinder (5); and, wherein the bending spring (33) is formed by a single component common with the piston unit (3) and is located in the pump chamber (32), the piston unit having a piston rod (13), the bending spring (33) forming a component with said piston rod (13).

17. A thrust piston pump according to claim 16, wherein the bending spring (33) is a one-part component with said piston rod (13).

18. A thrust piston pump according to claim 16, wherein the piston rod (33) has an inner end, the bending spring (33) being formed by said inner end of the piston rod (13).

19. A manually operated thrust piston pump for delivering media, said piston pump comprising:

a piston unit (3) having a pump piston (17) located substantially along a pump axis (4);

a cylinder (5) for displaceably receiving said piston unit (3);

at least one return spring (33) formed by a bending spring (33), said return spring (33) counteracting displacement of said piston unit (3) in said piston pump;

a pump chamber (32) defined by said pump piston (17) and said cylinder (5); and, wherein the bending spring (33) is formed by a single component with the piston unit (3) and is located in the pump chamber (32), and wherein said piston unit (3) has a discharge valve (20) comprising a valve seat (22) and a valve body (21) integrated with the piston collar (17), a radially outer face (40) of the bending spring (33) being connected to the valve seat (22) of said discharge valve (20), said piston collar (17) being axially displaceable with respect to the piston rod (13).

20. A manually operated thrust piston pump for delivering media, said thrust piston pump comprising:

a piston unit (3) having a pump piston (17) located substantially along a pump axis (4);

a cylinder 95) for displaceably receiving said piston unit (3);

at least one return spring (33) formed by a bending spring (33), said return spring counteracting displacement of said piston unit (3) in said piston pump;

a pump chamber (32) defined by said pump piston (17) and said cylinder (5); and, wherein the piston spring (33) is formed by a single component common with the piston unit (3) and is located in the pump chamber 932), said bending spring (33) being guided on a sliding surface (36).

* * * * *

UNITED STATES PATENT AND TRADEMARK OFFICE

CERTIFICATE OF CORRECTION

PATENT NO. : 4,762,475

DATED : August 9, 1988

INVENTOR(S) : Karl-Heinz Fuchs

It is certified that error appears in the above-identified patent and that said Letters Patent is hereby corrected as shown below:

Column 1, line 49 delete "its".

Column 2, line 26 delete "s" and insert --is--.

Column 2, line 36 delete "subcombination" and insert --subcombinations--.

Column 2, line 65 delete "multiply-stepped" and insert --multiple-stepped --.

Column 2, line 65 delete "toward" and insert --towards--.

Column 2, line 66 after "forms" delete the comma; after "end" insert a comma.

Column 3, line 26 delete "24" and insert --13--.

Column 3, line 39, delete "13" (first occurrence) and insert --24--.

UNITED STATES PATENT AND TRADEMARK OFFICE

CERTIFICATE OF CORRECTION

PATENT NO. : 4,762,475

DATED : August 9, 1988

INVENTOR(S) : Karl-Heinz Fuchs

It is certified that error appears in the above-identified patent and that said Letters Patent is hereby corrected as shown below:

Column 7, line 34 delete "elastic" and insert --plastic--.

Column 8, line 29 delete "95)"and insert --(5)--.

Column 8, line 67 delete "933)" and insert --(33)--.

Column 10, line 29 delete "95)" and insert --(5)--.

Column 10, line 39 delete "932)"and insert --(32)--.

Signed and Sealed this

Twenty-first Day of April, 1992

*Attest:*

HARRY F. MANBECK, JR.

*Attesting Officer*

*Commissioner of Patents and Trademarks*